United States Patent [19]

Wright, Jr.

[11] Patent Number: 4,563,399

[45] Date of Patent: Jan. 7, 1986

[54] CHROMIUM PLATING PROCESS AND ARTICLE PRODUCED

[75] Inventor: Leslie S. Wright, Jr., Plainwell, Mich.

[73] Assignee: Michael Ladney, Grosse Pointe Shores, Mich.

[21] Appl. No.: 650,857

[22] Filed: Sep. 14, 1984

[51] Int. Cl.[4] ..... C25D 5/14

[52] U.S. Cl. ..... 428/626; 204/41; 428/667

[58] Field of Search ..... 204/41; 428/667, 621, 428/626, 635

[56] References Cited

U.S. PATENT DOCUMENTS

| | | | |
|---|---|---|---|
| 2,859,158 | 11/1958 | Schaer | 204/41 X |
| 2,871,550 | 2/1959 | Weinberg et al. | 204/41 X |
| 2,886,499 | 5/1959 | Schaer et al. | 204/41 |
| 3,478,684 | 11/1969 | Schafler et al. | 204/41 X |

FOREIGN PATENT DOCUMENTS

| | | | |
|---|---|---|---|
| 852673 | 10/1960 | United Kingdom | 204/41 |

*Primary Examiner*—G. L. Kaplan

*Attorney, Agent, or Firm*—Brooks & Kushman

[57] ABSTRACT

A chromium plating process wherein first and second chromium layers are employed to enhance corrosion resistance. The chromium layers are separated by a strike of dissimilar metal, preferably nickel deposited using live entry into the nickel electroplating bath.

12 Claims, 2 Drawing Figures

CHROMIUM PLATING PROCESS AND ARTICLE PRODUCED

TECHNICAL FIELD

This invention relates to electrodeposition, and, more particularly, to an electroplating process and plated articles made in accordance with such process.

BACKGROUND ART

Electroplating is a well known process by which a base material, such as a metal or plastic, is plated with a metal for decorative or protective purposes. The process is more formally defined by the ASTM (American Society for Testing and Materials) as the electrodeposition of an adherent metallic coating upon an electrode for the purpose of securing a surface with properties or dimensions different from those of the basis metal. ASTM B 374.

An electroplating process generally involves making the article to be plated cathodic in a solution of a salt of the coating metal. The anode may either be soluble (as with nickel, NI, and copper, Cu) and consist of the same metal, or it may be inert (such as with chromium, Cr).

Chromium plating is a distinct discipline within the field of electroplating. Chromium is almost always used as the final finish for nickel and copper-nickel decorative-protective systems. Chromium possesses the qualities of good corrosion resistance and resists wear and scratching. Among the applications for chromium plating is automotive exterior trim. The ASTM in specification B 456 rates this application as a very severe service condition, SC 4.

Decorative chromium is almost always applied over undercoatings of nickel or copper-nickel. A copper plating applied directly to the substrate provides a layer with relatively smooth or uniform surface characteristics. Nickel provides good adhesion for chromium and is quite corrosion-resistant. Nickel can be plated mat, semibright or fully bright. The nickel plate in a nickel-copper chromium or nickel-chromium composite has conventionally provided the main corrosion protection to the substrate. When using multiple layers of nickel in chromium plating, the first layer is normally a semi-bright nickel, and the second layer is of a bright nickel to provide a more lustrous adhesion surface for the chromium deposit.

There are a number of experience factors characteristic of chromium plating which must be considered in its practice. One factor is that the throwing power and the covering power of chromic acid-plating baths are among the poorest of any commercially used plating solution. In chromic acid-plating baths the current efficiency rises as the current density increases, at least within limits, and this phenomenon promotes non-uniform metal distribution on the plated article.

Another prominent factor is corrosion caused by dissimilar metal contact. By the very nature of electroplating metal coatings there is necessarily dissimilar metal contact. When an electrolyte, typically contaminated moisture, is available to complete the circuit corrosion will occur. As corrosion begins it progresses locally and forms a blister or cell until it reaches the substrate. This condition invites further corrosion and lateral spread from the site of the initial cell.

One technique for minimizing the deleterious effects of corrosion is to make the outer chromium layer microdiscontinuous to diffuse the galvanic action over the surface of the plated article. Microdiscontinuity can be achieved by making the chromium layer microcracked or microporous by known processes. This minimizes cell concentration and causes a slow, general corrosion of the surface rather than gross corrosion at a few spots or cells. However, even though microdiscontinuity tends to spread or diffuse the galvanic action, eventually the composite effect is to create an undesirable gradual dulling of the chromium plated surface.

Another factor, is that nickel is a relatively expensive plating material, and controlling its thicknesses to within prescribed dimensional limits introduces complexity and cost to the overall plating process.

DISCLOSURE OF THE INVENTION

An objective of the present invention is to provide an improved chromium plating process which yields the desired results of decorativeness and hardness of known processes and enhances the corrosion resistance of the plated article.

Another objective of the present invention is to realize these benefits and lower the overall cost of the plating process.

In general, the present invention is carried out by using a second layer of chromium which is separated from the first layer by an adhering dissimilar metal. In practice, this involves the following pertinent steps. Starting with a prepared substrate, a bright nickel layer is plated to a normal thickness sufficient to cover the work piece and provide a bright appearance. A standard chromium plate of about 0.000015 inch is then applied. After rinsing, a strike or very thin plate of a dissimilar metal, preferably nickel, is plated. The work piece is then rinsed and returned preparatory to the plating of a second layer of chromium of about 0.000015 inch.

The layers underneath the first chromium plated layer are present for appearance and adhesion only, and need not be a special formulation to prevent corrosion penetration. Corrosion penetration is stopped at the chromium layers independent of the thicknesses and composition of the nickel or copper-nickel layers usually below the chromium layer.

The result is an electroplated article with improved corrosion resistance yielded from a process with a reduced requirement in total metal application, and, therefore, correspondingly reduced capital equipment requirements.

BEST MODE FOR CARRYING OUT THE INVENTION

Figure 1:
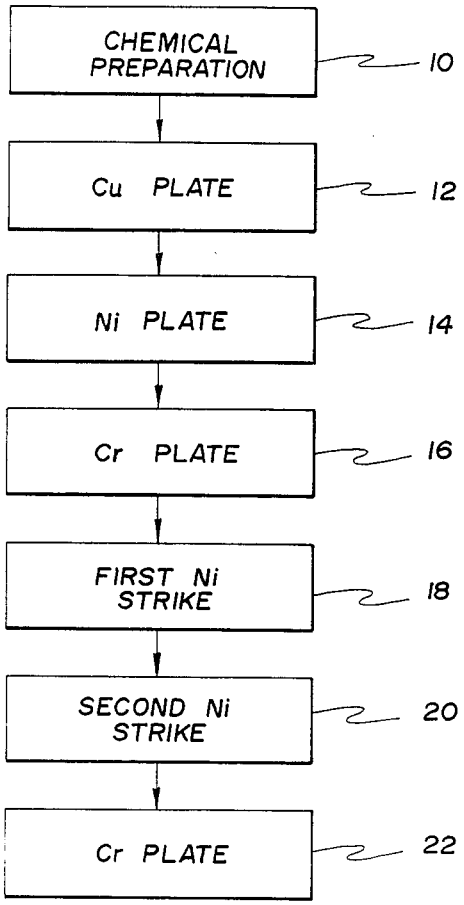
FIG. 1 is a flow chart of the process steps of the preferred form of the method of the present invention.
Figure 2:
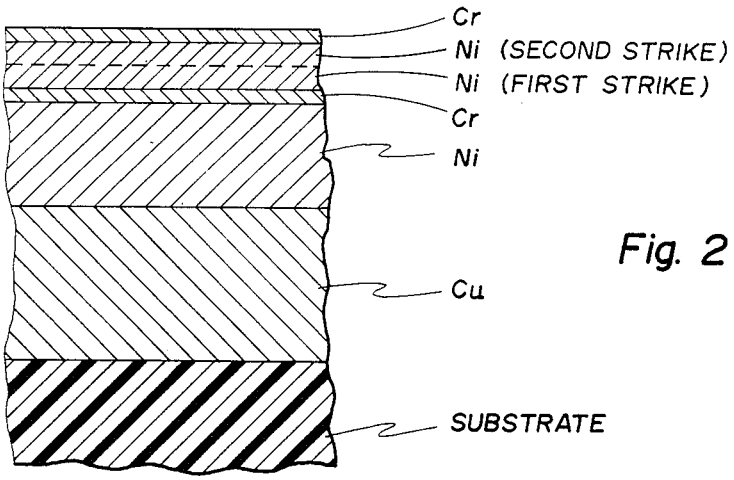
FIG. 2 is a cross-sectional view of an article plated in accordance with the present invention showing in schematic form the layers corresponding to the process steps of FIG. 1.

With reference to the drawing, in step 10 the substrate to be plated is cleaned to remove contaminants that would interfere with satisfactory deposition of an adherent finish. The chemical preparation contemplated in step 10 depends on the nature and quantity of the soil on the substrate, and many cleaning methods known in the art are acceptable for purposes of this preparation.

The substrate may be either a metal or a plastic, both being suitable for plating by the process of the present invention. If a metal, the substrate may be, for example, steel, zinc die cast, brass, copper or nickel. If a plastic, the substrate may be, for example, an ABS resin, polypropylene or other plateable plastic polymer. These materials can be conditioned for electroplating by any of the several known processes.

In step 12, the substrate receives an electrochemically deposited layer of copper preparatory to subsequent chromium plating. The copper serves as an undercoat and exhibits desirable surface uniformity. The copper plating step is not essential if alternative surface preparation for smoothness is employed, such as mechanical buffing.

In step 14, a layer of standard bright nickel is plated to a minimal thickness sufficient to cover the substrate.

In step 16, a standard chrome plate of about 0.000015 inch is applied.

In step 18, a strike or very thin plate of metal dissimilar to chromium is applied. This dissimilar metal is preferably nickel, but may be, for example, cobalt which possesses properties similar to nickel and is the middle member of the triad of Group VIII of the elements. It is important only that the strike layer obtain coverage of the work piece, as its thickness is not crucial given the advantage of the present invention.

A composition bath and related control parameters for step 18 can be as follows.

Ni $Cl_2$-$H_2O$ : 30 oz/gal
HCL: 10 oz/vol
Boric Acid: 2–3 oz/gal
Temperature: 70°–90° F.
Time: 2–3 minutes or as necessary for complete coverage
Plating Current: 30–60 amps per sq. ft.

This composition bath is selected to provide a nickel which will offer good adhesion to thwe chromium layer.

For best results, the work piece should enter the tank with the voltage on (live entry) and leave the tank with the voltage on (live exit).

In step 20, the work piece preferably receives a second strike of adhering dissimilar metal, which for the sake of consistency is shown again as nickel. This strike is a bright nickel to enhance the luster of the chromium layer covering. Two acceptable compositions for the bath in which this second nickel strike is electrochemically deposited are as follows.

| | A | B |
|---|---|---|
| Boric Acid | 6 oz/gal | 6 oz/gal |
| Nickel Sulfate | 20 | 8 |
| Nickel Chloride | 15 | 30 |
| pH | 3.5–4.5 | 3.5–4.5 |
| Saccharine Type | | |
| Brighteners such as: | | |
| Udylite #63 | 2% | 0 |
| Udylite #4 | 1% | 1% |
| Udylite #61 | 0.1% | 0 |
| Udylite #7 | 0 | 2% |
| Udylite 2KL | 0 | 0.1% |

Once again, the thickness of the second nickel strike is not as important as the requirement that the work piece be covered with the material.

In step 22, the second or outer chromium layer is electrochemically deposited to the work piece. Once again, this layer is of a normal thickness of about 0.000015 inch.

In all of the foregoing process steps, any ancillary or intermediate steps, such as rinsing, have not been expressly shown or described as the need for the steps and their method of practice would be well known to one having ordinary skill in the electroplating art.

The outer chromium layer may further be caused to be microdiscontinuous by being microcracked or made microporous. This feature can ensure that any development of corrosion will be diffused across the surface of the plated article.

The present invention has been shown by test procedures to yield enhanced corrosion protection for decorative chromium plated articles. By way of comparison, conventionally plated decorative chromium normally requires 0.0008 inch of nickel in a double layer to prevent penetration to the corrodible substrate in two-three years in a northern climate where salt is used, or, alternatively, to pass a 44 hour Copper-accelerated Acetic Acid Salt Spray (CASS) Test. An article plated in accordance with the present invention with but 0.0004 inch of total nickel exhibited no corrosion penetration after 66 hours of the CASS Test. A conventionally plated decorative chrome article with the same 0.0004 inch nickel exhibited corrosion as early as at 22 hours of the CASS Test, and thereafter showed severe surface pitting at 44 hours.

In summary, the present invention yields decorative chromium plated articles with enhanced corrosion resistance and potentially reduced material requirements. Any reduction in material requirement is, in turn, reflected in a corresponding reduction in capital equipment needs.

I claim:

1. A process for electroplating a chromium finish on a substrate comprising the steps of:

a. preparing the substrate for the application of a first chromium layer;
b. electrochemically depositing the first chromium layer onto the prepared substrate;
c. electrochemically depositing a strike of dissimilar metal onto the first chromium layer by live entry of the substrate into a plating composition; and
d. electrochemically depositing a second chromium layer onto the strike of dissimilar metal.

2. The process of claim 1 wherein step a. includes electrochemically depositing a nickel undercoating.

3. The process of claim 1 wherein step a. includes electrochemically depositing copper-nickel undercoatings.

4. The process of claim 1 wherein the dissimilar metal at step c. is nickel.

5. The process of claim 1 wherein step c. includes the sub-steps of, depositing a first strike of nickel of a composition selected for its adhesive properties to the first chromium layer, and depositing a second strike of bright nickel of a composition selected to enhance the luster of the second chromium layer.

6. The process of claim 1 wherein the first chromium layer is approximately 0.000015 inch thick.

7. The process of claim 1 wherein the second chromium layer is approximately 0.000015 inch thick.

8. The process of claim 1 wherein the strike of dissimilar metal is at least 0.00005 inch thick.

9. The process of claim 1 wherein the substrate is a plastic.

10. The process of claim 1 wherein the substrate is a metal.

11. The process of claim 1 wherein the second chromium layer is caused to be microdiscontinuous.

12. An article having an electroplated chromium finish made in accordance with the process of claim 1, 2, 3, 4, 5, 6, 7, 8, 9, 10, or 11.

* * * * *